US005165182A

United States Patent [19]

Michael

[11] Patent Number: 5,165,182

[45] Date of Patent: Nov. 24, 1992

[54] OPEN-ENDED SHOE COVER

[75] Inventor: Barry A. Michael, Roswell, Ga.

[73] Assignee: Kimberly-Clark Corporation, Neenah, Wis.

[21] Appl. No.: 633,745

[22] Filed: Dec. 21, 1990

[51] Int. Cl.[5] ..... A43B 3/00

[52] U.S. Cl. ..... 36/1.5; 36/2 R; 36/7.1 R

[58] Field of Search ..... 36/1.5, 2 R, 2 A, 2 B, 36/7.1 R, 100, 101, 132, 136

[56] References Cited

U.S. PATENT DOCUMENTS

| | | | |
|---|---|---|---|
| 2,287,744 | 6/1942 | Monahan | 36/7.2 |
| 2,305,926 | 12/1942 | Kohler | 12/142 |
| 2,422,669 | 6/1947 | Gygi | 36/2 |
| 2,657,477 | 11/1953 | Winslow | 36/2 |
| 3,296,489 | 1/1967 | Ceraldi | 317/2 |
| 3,399,329 | 8/1968 | Zimmon | 12/142 K |
| 3,459,997 | 8/1969 | Legge | 317/2 |
| 3,684,922 | 8/1972 | Ericson | 317/2 B |
| 3,798,503 | 3/1974 | Larsh et al. | 317/2 B |
| 4,019,265 | 4/1977 | Epstein | 36/7.1 R |
| 4,023,281 | 5/1977 | Terry | 36/7.1 R |
| 4,083,124 | 4/1978 | Michalak | 36/7.1 R |
| 4,272,859 | 6/1981 | Vanhove | 12/142 K |
| 4,598,485 | 7/1986 | Joe et al. | 36/7.2 |
| 4,604,816 | 8/1986 | Davison | 36/1.5 |
| 4,616,428 | 10/1986 | Leger | 36/7.1 R |
| 4,616,429 | 10/1986 | Alcala | 36/7.2 |
| 4,665,633 | 5/1987 | Edgerton | 36/2 R |
| 4,713,895 | 12/1987 | Vallières | 36/1.5 |
| 4,825,563 | 5/1989 | Strongwater | 36/73 |
| 4,847,934 | 7/1989 | Weber | 12/142 R |
| 4,896,437 | 1/1990 | Johnson | 36/1.5 |
| 4,918,839 | 4/1990 | Brandon | 36/7.1 R |

*Primary Examiner*—Paul T. Sewell
*Assistant Examiner*—Thomas P. Hilliard
*Attorney, Agent, or Firm*—Patrick C. Wilson

[57] ABSTRACT

Disclosed herein is a shoe cover which has an open-ended bottom such that when the shoe cover is placed over a shoe, the uppers portion of the shoe is covered and protected while the sole of the shoe is at least partially exposed so that the traction of the shoe itself may be utilized by the wearer. In more refined embodiments, the shoe cover is provided with a number of methods for providing additional securement of the shoe cover to the shoe of a wearer.

2 Claims, 3 Drawing Sheets

OPEN-ENDED SHOE COVER

BACKGROUND OF THE INVENTION

The present invention relates to a shoe cover for surgical and clean room use. Unlike conventional shoe covers which cover the entire shoe of the wearer, the shoe cover of the present invention leaves the sole of the wearer's shoe exposed so that the traction provided by the sole of the shoe itself may be utilized by the wearer.

Both disposable and reusable protective clothing have been used for many years in hospitals and clean rooms, either as primary clothing or as secondary clothing over the top of the other clothing. In the operating room, in particular, sterile protective clothing is required for the safety and protection of the patient as well as that of the operating room personnel. This type of clothing commonly includes some type of top or surgical gown which is often worn with protective pants to cover the wearer's legs. An additional article of protective wear often worn by the operating room personnel is shoe covers.

Those shoe covers known by the Applicant to be available today most typically cover the entire shoe of the wearer in addition to the ankles and possibly some other portion of the wearer's legs. Certain individuals prefer the traction of their own shoes over that of the traction provided by the shoe covers themselves. As a result, they elect not to wear shoe covers. Other hospital personnel work in areas were fire is a hazard and, as a result, grounding of the shoe cover is required. In such cases, the wearer will often have to tuck a conductive strap into his or her shoe, making the donning of the shoe cover more difficult. In contrast, if some portion of the sole of the shoe is exposed, the shoe itself can be designed to provide the necessary grounding, thereby eliminating the need for conductive shoe covers.

It therefore an object of the present invention to provide a shoe cover for use with surgical pants and other apparel which will permit the top portion of the shoe to be covered by protective apparel while still leaving at least a portion of the sole exposed for contact with walking surfaces. It is another object of the present invention to provide a shoe cover which will permit exposure of least a portion of the sole of the shoe for contact with walking surfaces.

These and other objects of the present invention will become more apparent upon a further review of the following specification, drawings and claims.

SUMMARY OF THE INVENTION

The present invention relates to a shoe cover for surgical and clean room use. Unlike conventional shoe covers which cover the entire shoe of the wearer, the shoe cover of the present invention leaves at least a portion of the sole of the wearer's shoe exposed so that the traction provided by the sole of the shoe itself may be utilized by the wearer. The shoe cover comprises a generally tubular section which is co-extensive with the leg and foot portions of the wearer. The shoe cover has an open top end and an open bottom end. The open top end has retention means for retaining the open top end about the leg of the wearer while the open bottom end defines a toe portion and a heel portion separated by opposed side portions. A retainment means is located in both the toe portion and the heel portion of the open bottom end for retaining the open bottom end of the shoe cover about the periphery of a shoe such that at least a portion of the sole is exposed for walking while the uppers portion of the shoe is covered by the shoe cover.

To provide additional securement of the shoe cover to a shoe, the shoe cover may be provided with securement means on the toe portion of the shoe cover, attachment means on the heel portion and side fastening means on each of the side portions of the shoe cover to further secure the shoe cover to a shoe. In alternate embodiments, the shoe cover may also be provided with a strap connecting the opposed side portions of the shoe cover and spanning the open bottom end intermediate the heel and toe portions of the shoe cover. Alternatively, the shoe cover may include a sole portion attached to the toe portion of the shoe cover which spans the open bottom end of the shoe cover adjacent the toe portion while leaving open the bottom end adjacent the heel portion to still provide exposure of the sole of the shoe itself.

DETAILED DESCRIPTION OF THE DRAWINGS

For purposes of description only, the shoe cover of the present invention will be described in conjunction with its use in health care applications. It should be understood, however, that the shoe cover of the present invention may be used in other applications outside the health care area, clean rooms being one example. It is therefore the intention of the Applicant that the shoe cover of the present invention not be limited to the particular uses listed herein. A shoe particularly well suited for use with the present invention is described and claimed in a co-pending application by the present Applicant in a commonly assigned application filed on even date herewith entitled "SHOE WITH SHOE COVER ATTACHMENT MEANS" bearing Ser. No. 07/632,284, now abandoned.

Figure 1:
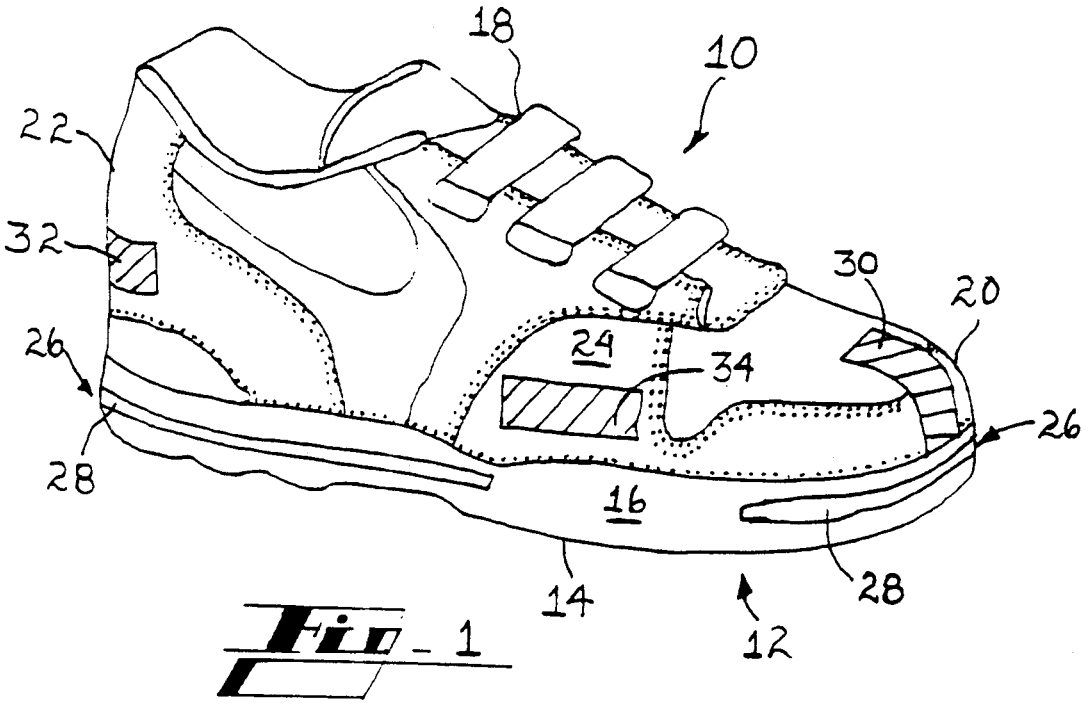
FIG. 1 is a perspective view of a shoe which is well-suited for use in conjunction with the shoe cover of the present invention.

Referring to FIG. 1, there is shown a shoe 10 which may be used in conjunction with the present invention. The shoe 10 includes a shoe sole 12 having a sole bottom 14 and a sole lip 16. Joined to the shoe sole 12 adjacent the sole lip 16 is a shoe upper 18. The shoe 10 has a shoe toe portion 20 and a shoe heel portion 22 separated by opposed shoe side portions 24. Located about the shoe periphery and, in particular, in the shoe toe portion 20 and shoe heel portion 22 is a shoe retainment means 26 for use in conjunction with the shoe cover of the present application. The shoe retainment means 26 is in the form of a groove 28 located in the lip 16 of the shoe sole 12. The groove 28 may extend around the entire periphery of the shoe 10 or be located only in the shoe toe portion 20 and/or shoe heel portion 22. In the tennis shoe construction shown in FIG. 1, the groove 28 may be molded or formed directly into the lip 16 of the shoe 10. Conversely, the groove 28 may formed in the shoe upper 18 or in the area where the shoe upper 18 is attached to the shoe sole 12. Furthermore, other configurations may be used instead of a groove 28 for the shoe retainment means 26 such as snaps, or hook and loop fastening members.

In addition to the shoe retainment means 26, the shoe 10 may be provided with shoe securement means 30 on the toe portion 20 and shoe attachment means 32 on the shoe heel portion 22 of the shoe 10. The shoe securement means 30 and shoe attachment means 32 are designed to act in conjunction with similar means on the shoe cover of the present invention as will be further described below. The shoe 10 also may include shoe side fastening means 34 located on the opposed shoe side portions 24 of the shoe 10 intermediate the shoe toe portion 20 and the shoe heel portion 22. These means 34 are also designed to act in conjunction with similar means located on the shoe cover of the present invention as will be described in further detail below. Each of the mating means 30, 32 and 34 on the shoe 10 as well as the similar means on the shoe cover of the present invention may be made from snaps, hook and loop fasteners (such as Velcro® hook and loop fasteners), pressure sensitive adhesive tapes and combinations of the foregoing. These means may be sewn, glued or bonded to the respective components of the shoe 10 and the shoe cover of the present invention.

Figure 2:
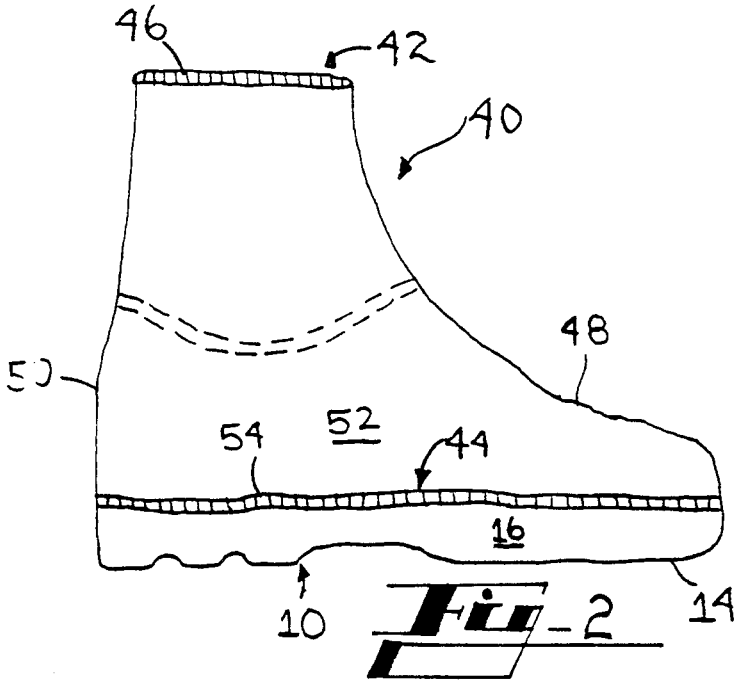
FIG. 2 is a side view of a shoe cover according to the present invention.

Referring to FIG. 2, the shoe cover 40 of the present invention is generally tubular in shape and coextensive with the leg and foot portions of a wearer (not shown). The shoe cover 40 may be made from any well known materials suitable for shoe covers. One material which is particularly well-suited for the present invention is "EVOLUTION" fabric sold by the Kimberly-Clark Corporation of Neenah, Wis. The shoe cover 40 has an open top end 42 and an open bottom end 44 which is generally larger than the open top end 42. Located about or in close proximity to the open top end 42 is a retention means 46 for retaining the open top end 42 about the leg of the wearer. The open bottom end 44 of the shoe 40 defines a toe portion 48 and heel portion 50 separated by opposed side portions 52. The open bottom end 44 includes retainment means 54 located about or in close proximity to the open bottom end 44 in both the toe portion 48 and the heel portion 50. The purpose of the retainment means 54 is to retain the open bottom end 44 of the shoe cover 40 about the periphery of the shoe 10 while still keeping at least a portion of the shoe sole 14 exposed for contacting walking surfaces. In FIG. 2 a preferred construction is shown wherein the retainment means 54 extends about the entire periphery of the open bottom end 44 of the shoe cover 40. The retention means 46 and the retainment means 54 shown in FIGS. 2 through 5 comprise elastic members which are sewn, glued or bonded to the shoe cover. Alternatively, however, other materials such as snaps, drawstrings, pressure sensitive tapes and hook and loop fasteners may be used as the retention means 46 and retainment means 54 of the present invention.

Figure 3:
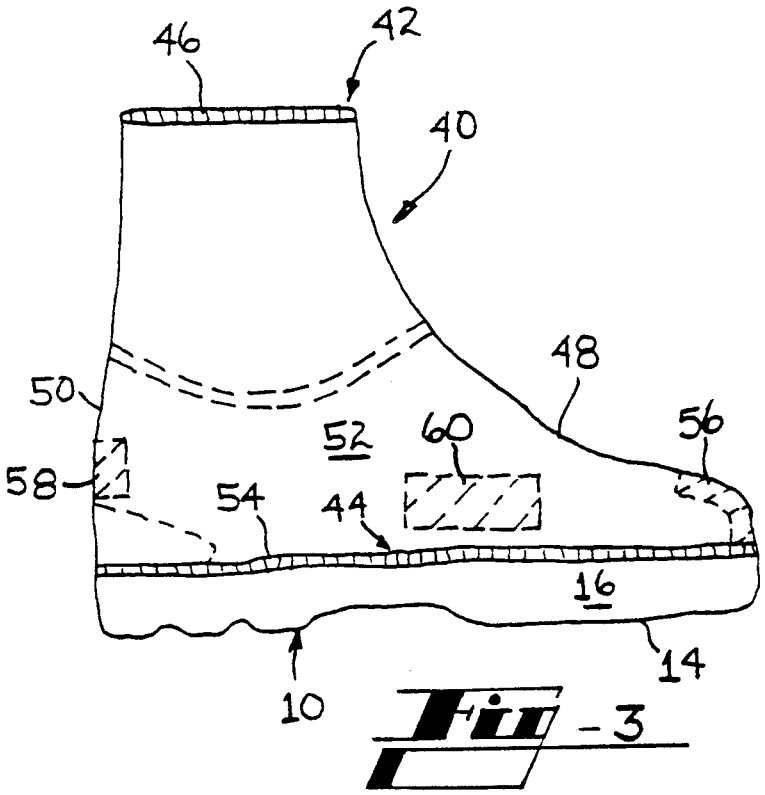
FIG. 3 is a side view of another shoe cover according to the present invention.

Another embodiment of the present invention is shown in FIG. 3 of the drawings. In this embodiment the shoe cover 40 is provided with securement means 56 on the toe portion 48 for securing the toe portion 48 of the shoe cover 40 in mating relationship with the shoe securement means 30 of the shoe 10. On the heel portion 50 of the shoe cover 40 there is also provided attachment means 58 for securing the heel portion 50 in mating relationship with the shoe attachment means 32 of the shoe 10. Furthermore, the shoe cover 40 may be provided with side fastening means 60 on one or both of the side portions 52 of the shoe cover 40 for securing the side portion 52 in mating relationship with the shoe side fastening means 34 of the shoe 10.

The securement means 56, attachment means 58 and side fastening means 60 shown in FIG. 3 are of the hook and loop fastener type, however, other combinations of means listed herein may be substituted to achieve the same function. Additionally, the means 56, 58 and 60 may be used individually or in any combination with the other means of the present invention.

Figure 4:
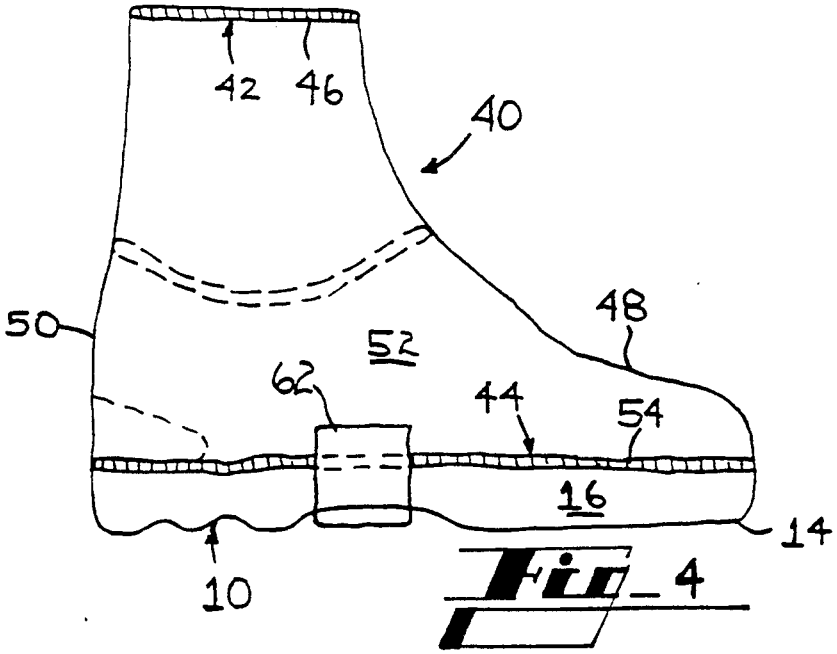
FIG. 4 is a side view of yet another shoe cover according to the present invention.

Referring to FIG. 4 there is shown yet another embodiment of the present invention. In FIG. 4 the shoe cover 40 is shown as having a strap 62 connecting opposed side portions 52 of the shoe cover 40 while spanning the open bottom end 44 intermediate the heel portion 50 and toe portion 48 of the shoe cover 40. The strap 62 may be made either elastic or non-elastic with the purpose of holding the shoe cover 40 over the shoe upper 18 while still exposing the shoe sole 14 of the shoe 10. As with the other embodiments, the strap 62 may be used alone or in combination with any or all the other means of the present invention.

Figure 5:
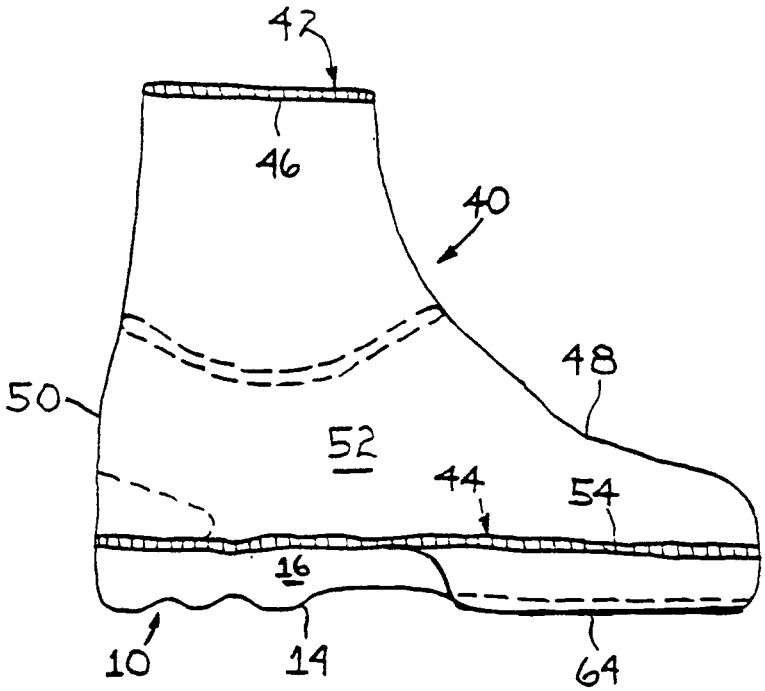
FIG. 5 is a side view of still a further shoe cover according to the present invention.
Figure 6:
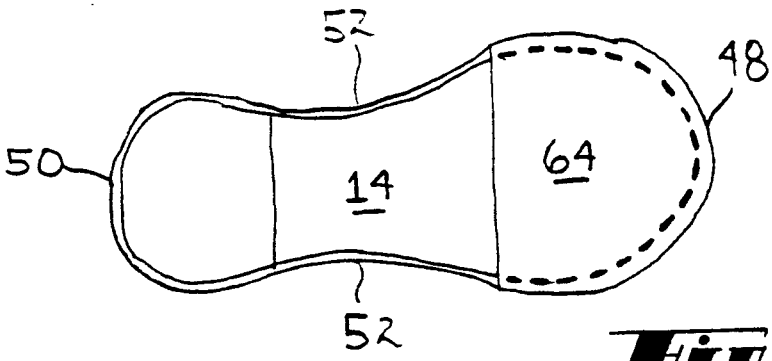
FIG. 6 is a bottom view of the shoe cover of FIG. 5.

A further embodiment of the present invention is shown in FIGS. 5 and 6 of the drawings. In this embodiment, the shoe cover 40 includes a sole portion 64 which is attached to the toe portion 48 of the shoe cover 40 and spans the open bottom end 44 adjacent the toe portion 48 while leaving open the open bottom end 44 adjacent the heel portion 50 of the shoe cover 40. As with the other embodiments, the sole portion 64 may be used alone or in combination with any or all of the other means of the present invention.

Having thus described the invention in detail, it should be appreciated that various modifications and changes can be made in the present invention without departing from the spirit and scope of the following claims.

What is claimed is:

1. A shoe cover for use in conjunction with a shoe having a sole portion attached to an uppers portion comprising:

a generally tubular section coextensive with the leg and foot portions of a wearer, said shoe cover having an open top and an open bottom end, said open top end having retention means for retaining said open top end about the leg of the wearer, said open bottom end defining a toe portion and a heel portion separated by opposed side portions, said open bottom end having elastic retainment means located about the periphery of said open bottom end for retaining said open bottom end of said shoe cover above the periphery of the shoe such that at least a portion of the sole of the shoe is still capable of being exposed, and attachment means on said heel portion of said shoe cover above said elastic retainment means for attaching said heel portion of said shoe cover to the shoe.

2. A shoe cover for use in conjunction with a shoe having a sole portion attached to an uppers portion comprising:

a generally tubular section coextensive with the leg and foot portions of a wearer, said shoe cover having an open top end and an open bottom end, said open top end having retention means for retaining said open top end about the leg of the wearer, said open bottom end defining a toe portion and a heel portion separated by opposed side portions, said open bottom end having elastic retainment means located about the periphery of said open bottom end for retaining said open bottom end of said shoe cover about the periphery of the shoe such that at least a portion of the sole of the shoe is still capable of being exposed, securement means on said toe portion of said shoe cover above said elastic retainment means for securing said toe portion of said shoe cover to the shoe and, attachment means on said heel portion of said shoe cover above said elastic retainment means for attaching said heel portion of said shoe cover to the shoe.

* * * * *